US007056224B1

(12) United States Patent
Keyes

(10) Patent No.: US 7,056,224 B1
(45) Date of Patent: Jun. 6, 2006

(54) GOLF SWING TRAINING APPARATUS

(76) Inventor: Robert M Keyes, 2245 Sunningdale Rd., Kingsport, TN (US) 37660

( * ) Notice: Subject to any disclaimer, the term of this patent is extended or adjusted under 35 U.S.C. 154(b) by 61 days.

(21) Appl. No.: 10/738,771

(22) Filed: Dec. 17, 2003

(51) Int. Cl.
*A63B 69/36* (2006.01)

(52) U.S. Cl. ..... 473/257; 473/229

(58) Field of Classification Search ..... 473/55, 473/219, 223, 229, 422, 451, 252, 257–263; 482/99, 100, 101, 102, 114, 121, 122, 129, 482/133, 137, 138, 139, 142, 908; 601/24
See application file for complete search history.

(56) References Cited

U.S. PATENT DOCUMENTS

| | | | | | |
|---|---|---|---|---|---|
| 1,137,349 | A | | 4/1915 | Patterson | |
| 1,399,761 | A | | 12/1921 | Garland | |
| 1,567,530 | A | | 12/1925 | MacNaughton | |
| 1,634,102 | A | * | 6/1927 | Hansen | 473/229 |
| 1,670,409 | A | * | 5/1928 | Hansen | 473/229 |
| 2,756,056 | A | | 7/1956 | Zega | |
| 3,711,103 | A | * | 1/1973 | Seltzer | 473/229 |
| 3,794,329 | A | * | 2/1974 | Wilson | 473/229 |
| 3,966,203 | A | | 6/1976 | Bickford | |
| 4,135,714 | A | | 1/1979 | Hughes | |
| 4,229,002 | A | | 10/1980 | Masters | |
| 4,640,268 | A | * | 2/1987 | Roberts | 601/24 |
| 5,018,725 | A | * | 5/1991 | Cook | 482/103 |
| 5,050,874 | A | | 9/1991 | Fitch | |
| 5,072,942 | A | | 12/1991 | Hurley | |
| 5,102,122 | A | * | 4/1992 | Piane et al. | 482/133 |
| 5,197,933 | A | * | 3/1993 | Waters | 482/101 |
| 5,242,344 | A | | 9/1993 | Hundley | |
| 5,284,464 | A | | 2/1994 | Lee | |
| 5,441,255 | A | * | 8/1995 | Verbick | 473/55 |
| 5,467,993 | A | | 11/1995 | Higginson | |
| 5,895,327 | A | * | 4/1999 | Francisco | 473/229 |
| 6,165,110 | A | * | 12/2000 | Gajda | 482/102 |
| 6,537,184 | B1 | | 3/2003 | Kim | |
| 6,705,976 | B1 | * | 3/2004 | Piane, Jr. | 482/103 |

* cited by examiner

*Primary Examiner*—Nini F. Legesse

(57) ABSTRACT

A golf swing training apparatus that stretches and strengthens the precise parts of the body used in the golf swing while providing a tool to make swing changes. The apparatus employs a swing guide track, which is mounted on a base in such a manner that the track follows the golfer's normal golf swing, accommodating any type of swing. The swing track is maneuverable by the golfer, consciously or unconsciously, to more precisely accord to the special stylistic features of the golfer's unique swing, and wherein a consistent pull or resistance is provided and is attached to a golf handle, which the golfer swings on a movable swing plane while the plane is in motion.

5 Claims, 11 Drawing Sheets

GOLF SWING TRAINING APPARATUS

CROSS-REFERENCE OF RELATED APPLICATIONS

Not Applicable

FEDERALLY SPONSORED RESEARCH

Not Applicable

SEQUENCE LISTING OR PROGRAM

Not Applicable

BACKGROUND OF INVENTION

1. Field

This invention relates to golf swing training, generally, a device used by a player to train for a game or sport using a tangible projectile, the invention specifically stretches the parts of the body used for the backswing and follow-thru, strengthens the muscles used for the downswing and is a teaching aid to correct many swing flaws.

2. Prior Art

Golf training through exercise is a comparatively new field for such an old game. Up until the last 20 years or so golfers generally avoided most physical training exercises for fear of losing their swing from physical body changes. As training techniques have progressed, golfers have worked more on physical fitness and golf specific muscles.

Although there have been some golf swing casualties in the professional ranks from body changes due to physical workouts, younger pros have achieved more promising results. Up until the present time, stretching and strengthening golf muscles has been achieved by improving overall physical fitness and using specific exercises for golf muscle groups.

Spending so much time exercising is a noble goal for those who have the time like the pros, but working amateurs with families cannot usually find the time. Many training aids have been developed that have not been widely accepted. Others, that have been widely sold, rarely fulfill their advertised claims. Some current exercise training products involve a belt around the torso with an elastic cord attached to the club handle. Although they claim to stretch and strengthen the golf swing, these products usually do the opposite. They provide resistance on the backswing and follow-thru where stretching is actually required and elastic pulling on the downswing where resistance is required.

Other golf training products that haven't made it to market include the use of pivotal resistance with the resistance mechanism in front of the golfer and some form of arm to rotate by the golfer for exercising the swing such as Lee and Leadbetter in U.S. Pat. No. 5,284,464 and Hundley in U.S. Pat. No. 5,242,344. These are very rigid devices for swing training and often resist backswing motion where pull is actually required. Also, a golfer's backswing and downswing is normally on different swing planes and swing circumferences have odd shapes that are not rigid. The prior devices do not accommodate such variations in golf swings and can create problems associated with undesirable swing alterations.

Other devices employ vertical resistance through pulleys, guides, weights and springs to offer resistance for a portion of the downswing such as Bickford in U.S. Pat. No. 3,966,203, Masters in U.S. Pat. No. 4,229,002 and Kim in U.S. Pat. No. 6,537,184. U.S. Pat. No. 6,537,184 offers some origin movement using a sliding pulley on a trolley connected to springs, but offers no real improvement over the other inventions, particularly since pulleys do not work on such angles, especially when resistance is decreased and increased. Also, the club never gets close to the top of the backswing and the club handle is pointed away from the golfer at the so-called top causing the wrists to start down without being cocked. Just like U.S. Pat. No. 3,955,203 and U.S. Pat. No. 4,229,002, U.S. Pat. No. 6,537,184 fails to solve the problem of providing resistance for the whole downswing or even accommodating the whole backswing and downswing. Of course stretching in these devices isn't even addressed.

Still other devices involve railed or guided golf swing planes, which force the golfer to swing on some predetermined swing path. Hurley in U.S. Pat. No. 5,072,942, Beckish in U.S. Pat. No. 4,071,251, and Higginson in U.S. Pat. No. 5,467,993 are examples of these types of devices. These path guides assume swings are or should be on one flat plane, which they normally are not, and there is no pull or resistance exercise provided.

The challenges of golf swing training equipment are many and result from real life factors such as that the golf swing is 3-dimensional; golfers' height, limb length, flexibility, swing type and other physical aspects make each swing different; a player's backswing is not on one plane and is rarely on the same plane as the downswing; and by exercising specific groups of muscles on different non-golf apparatus, the golf muscles do not always proportionately remain the same and coordination and feel can suffer.

OBJECTS OF THE INVENTION

Objects therefore of the present invention are:

(a) to provide adjustable pull or resistance to a golfer's swing to stretch both the entire backswing and follow-thru and to strengthen the muscles used for the downswing;

(b) to provide a swing plane track with means for adjusting same to different swing diameters and heights;

(c) to provide for an adjustable swing plane angle of said track accommodating very upright to very flat swing planes;

(d) to provide a swing plane track that rotates so that the track follows the normal or natural swing path of the golfer and also to serve as a platform so that the golfer can work on changing his or her swing plane;

(e) to provide for a lateral movement of said track for golfers who start their downswing with lateral movement;

(f) to provide a training device that will teach golfers not to cast, release the club early, come over the top, swing from outside to in, or reverse weight shift; and (g) to provide a relatively compact golf swing training apparatus which can readily be used at home.

SUMMARY OF THE INVENTION

A golf swing training apparatus which stretches and strengthens the precise parts of the body used in the golf swing while providing a tool to make swing changes. The apparatus fully accommodates all variations of the entire backswing and downswing thru the hitting area and further provides pull during the backswing and follow-thru, and resistance during the downswing. These gainful aspects are attained thru the use of a swing guide track, provided with a swing pull-resistance mechanism, and which is mounted on a base in such a manner that the track follows the swing path of the golfer and is maneuverable by the golfer, consciously or unconsciously, to more precisely accord to special stylistic features of the golfers unique swing.

BRIEF DESCRIPTION OF THE DRAWINGS

The invention, it's objects and advantages will be understood further from the drawings herein and description of preferred embodiments, wherein.

Figure 1:
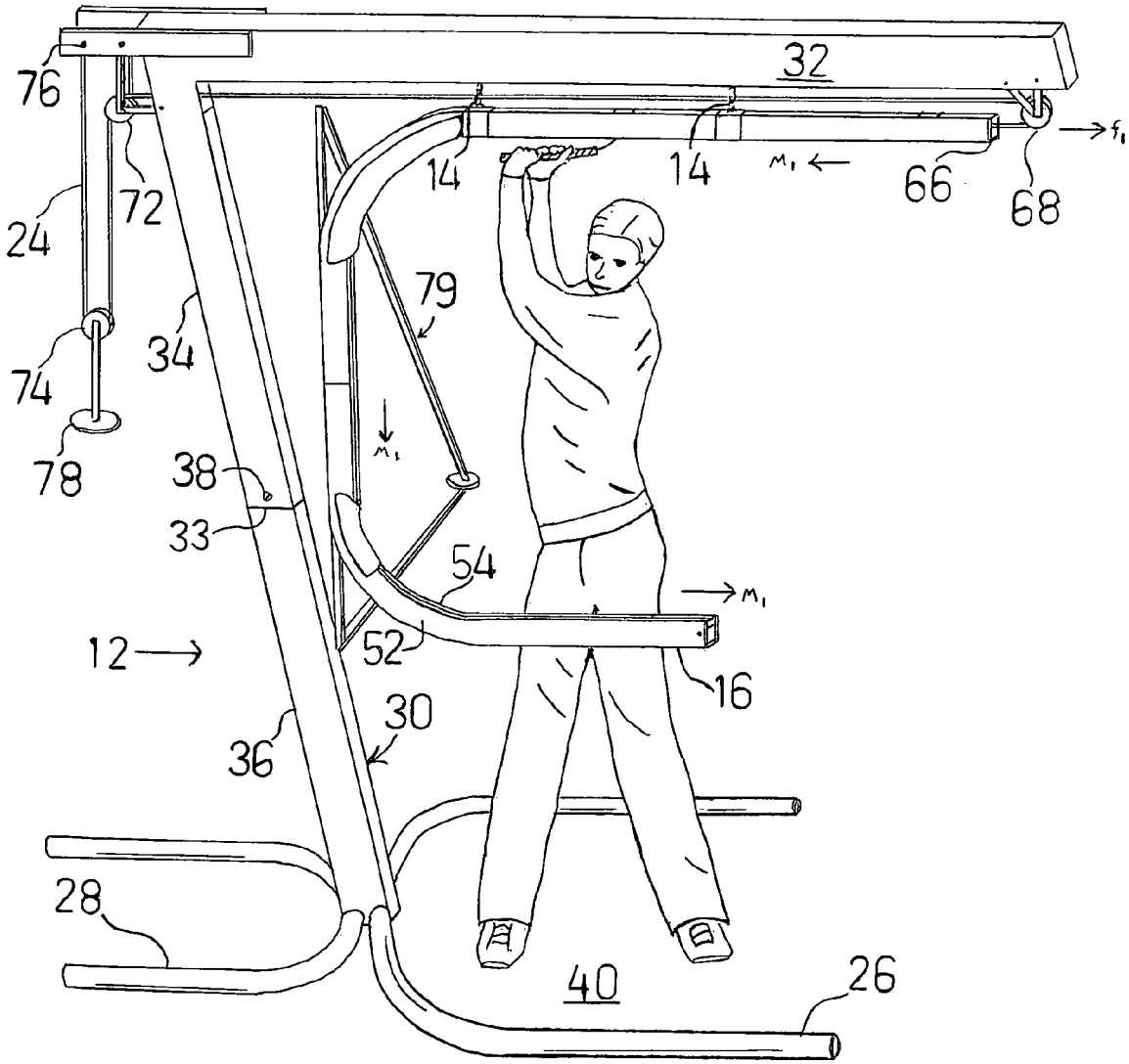
FIG. 1 is a side perspective view of the present golf swing training apparatus.

| Drawings—Reference Numerals | |
|---|---|
| 12 | Base Structure |
| 14 | Support Structure |
| 16 | Swing Guide Track |
| 17 | Curvature Dimension |
| 18 | Swing Plane |
| 20 | Track Follower (car) |
| 22 | Handle |
| 24 | Motion Resistance Structure |
| 26 | 1st Base Foot |
| 28 | 2nd Base Foot |
| 30 | Stanchion |
| 32 | Horizontal Beam |

-continued

| Drawings—Reference Numerals | |
|---|---|
| 33 | Stanchion Overlap |
| 34 | Upper Stanchion |
| 36 | Lower Stanchion |
| 38 | Stanchion Pin |
| 40 | Floor |
| 43 | Upper Bearing |
| 44 | Lower Bearing |
| 46 | Bearing Loop |
| 48 | Upper Bushing |
| 50 | Lower Bushing |
| 52 | 1st Track Channel Member |
| 54 | 2nd Track Channel Member |
| 56 | Track Cross Member |
| 58 | Lead Cord Connecting Car |
| 60 | 2nd Cord Connecting Car |
| 61 | Connecting Car Eyelet |
| 62 | Connecting Cords |
| 64 | Duel Cords |
| 65 | Car Stop Pin |
| 66 | Proximal Track End |
| 68 | 1st Track End Pulley |
| 70 | 2nd Track End Pulley |
| 72 | Duel Pulleys |
| 74 | Duel Weight Pulleys |
| 76 | Cord Fixture |
| 78 | Resistance Weights |
| 79 | Track Plane Adjustment Mechanism |
| 80 | Vertical Plane Adj. Member |
| 82 | Diagonal Plane Adj. Member |
| 84 | Horizontal Plane Adj. Member |
| 86 | Stabilizing Rod |
| 87 | Stabilizing arm |
| 88 | Weight Support |
| 90 | Diameter Adjustment Holes |
| 91 | Cotter Pin |
| 92 | Cotter Bolt |
| 93 | Track Diameter Adj. Mechanism |
| 95 | Track Roller Section |
| 97 | Cord Support Rollers |
| 99 | Channel Punch-outs |

DETAILED DESCRIPTION OF THE INVENTION

Figure 8:
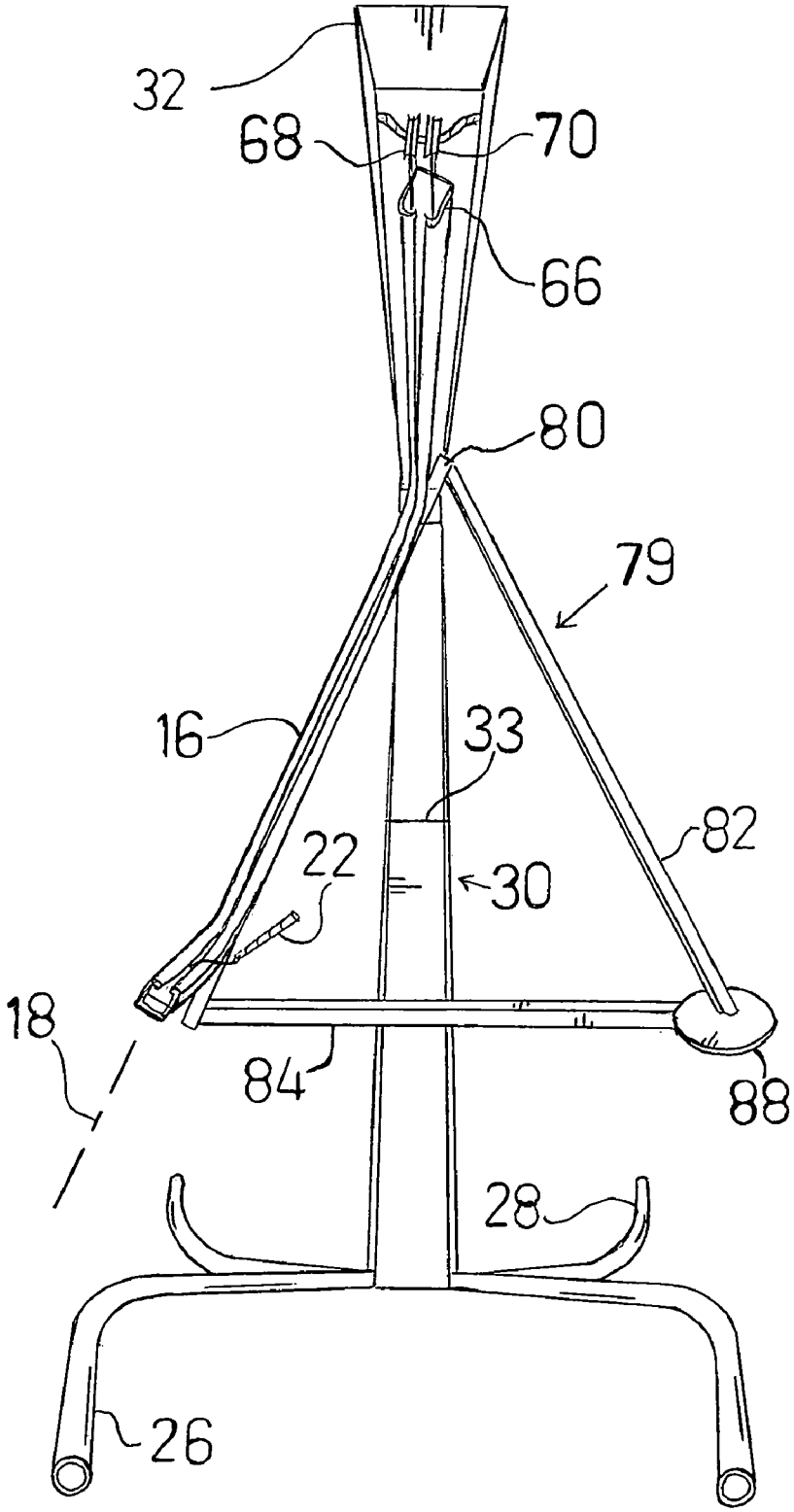
FIG. 8 is a front view of the present apparatus shown in FIG. 1.

Referring to the drawings and with particular reference to the claims herein, a preferred embodiment of the present apparatus comprises a base structure generally designated 12 and a support structure 14 for attaching a generally upright swing guide track 16 to the base (FIGS. 1 and 8). The track has an overall curvature of at least 90 degrees (FIG. 1A) within a swing plane 18 (FIG. 8), wherein the base is stationary and wherein the support is flexible to allow the track limited freedom of motion relative to the base. The overall curvature dimension 17 (FIG. 1A) consists of three sides with preferred ranges of d1=60" to 80", d2=40" to 60", and d3=32" to 42".

A track follower 20 engages the track for movement there along throughout the curvature dimension 17, and a handle 22 (most clearly in FIG. 2 and FIG. 3) is affixed to the follower for being gripped by a golfer for movement of the follower 20 by the golfer.

A motion resistance structure 24 (FIG. 1) is connected to the base 12 and the follower 20 to provide a back force f1 to forward motion M1 of the handle 22 and the follower 20 through the curvature dimension 17, whereby the golfer's swing muscles become strengthened against the back force, and said muscles become stretched with backward motion of the handle 22 by said back force, and whereby the swing thus becomes stronger and longer with regard to a desired trajectory.

Base 12 can of course be structurally varied widely depending on available space or the like and the base structure shown is well suited for a free standing compact training unit for home use. The base shown comprises of foot sections 26 and 28 (FIGS. 1 and 8) rigidly affixed to a stanchion 30 which is affixed at the upper end to a generally horizontal beam 32. Stanchion 30 preferably is formed in sections 34 and 36 wherein section 34 can slide upwardly at stanchion overlap 33 for adjusting the height of beam 32 above the floor 40 (FIG. 1) and is affixed with the stanchion pin 38. The stanchion 30 height adjustment of one section sliding and being affixed in place onto the other section can be provided in many ways.

Figure 6:
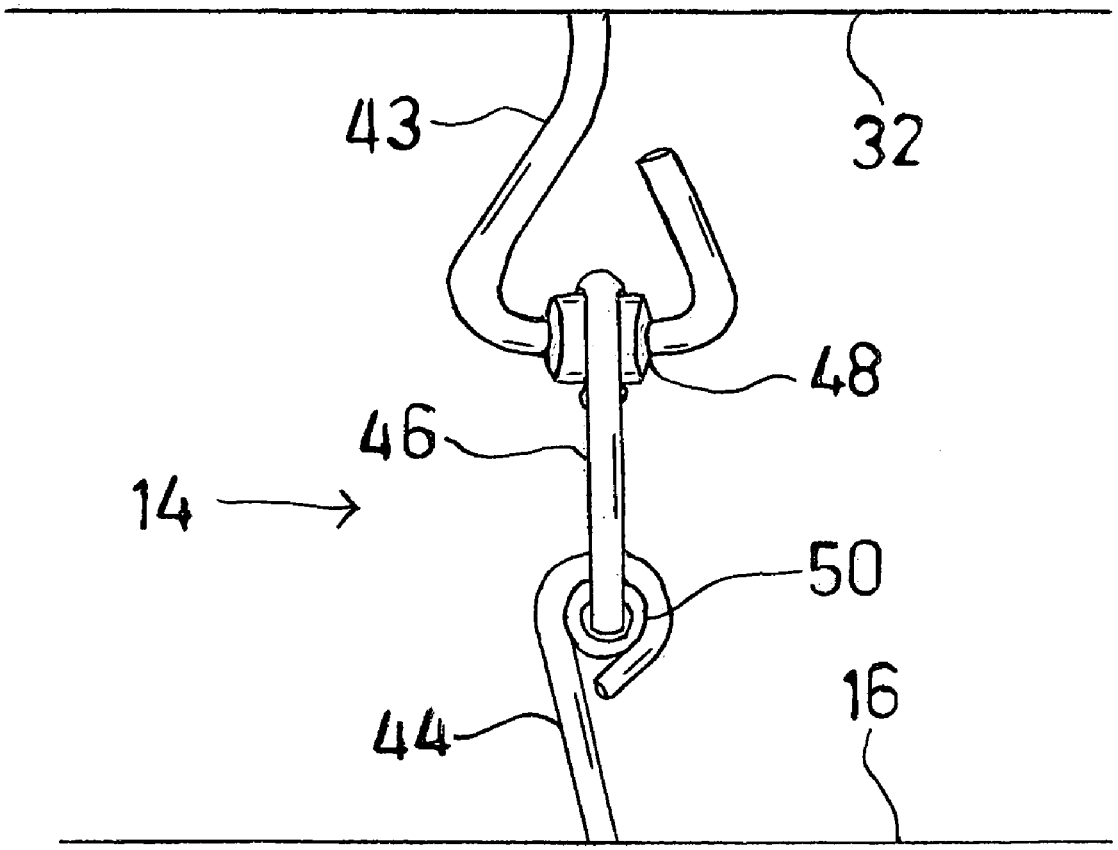
FIG. 6 is a double swing bearing mount support structure connecting the swing track to an overhead beam of a base structure.

Support 14 preferably comprises the dual bearing mount (FIG. 6) wherein upper bearing 43 is attached to beam 32 and lower bearing 44 is attached to track 16. Bearing loop 46 is pivotally mounted in upper bushing 48 and lower bushing 50 affixed to bearings 43 and 44 respectively. The bearing mount gives the desired universal type freedom of motion to the track whereby the golfer during the swing does not feel uncomfortably restrained.

Figure 4:
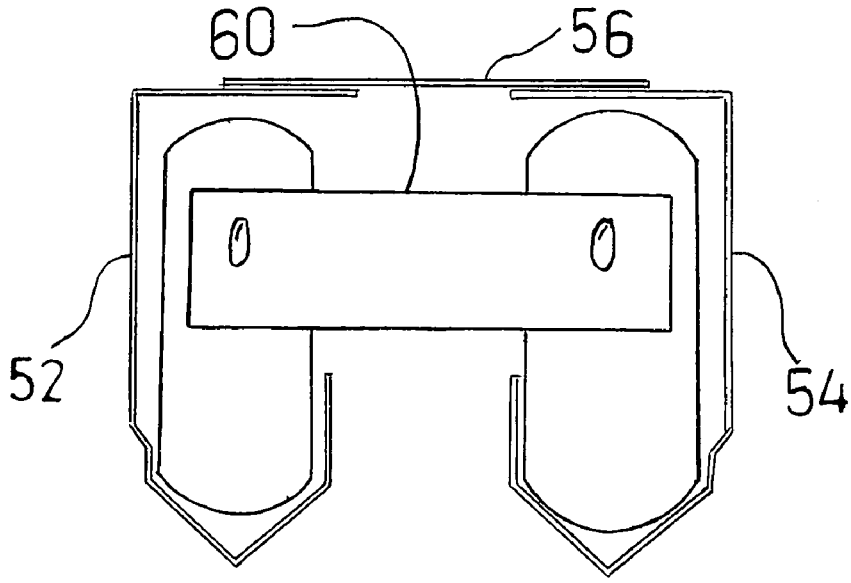
FIG. 4 is a cross-section of a swing track with an end view of a cord connecting car mounted thereon as in FIG. 2.
Figure 5:
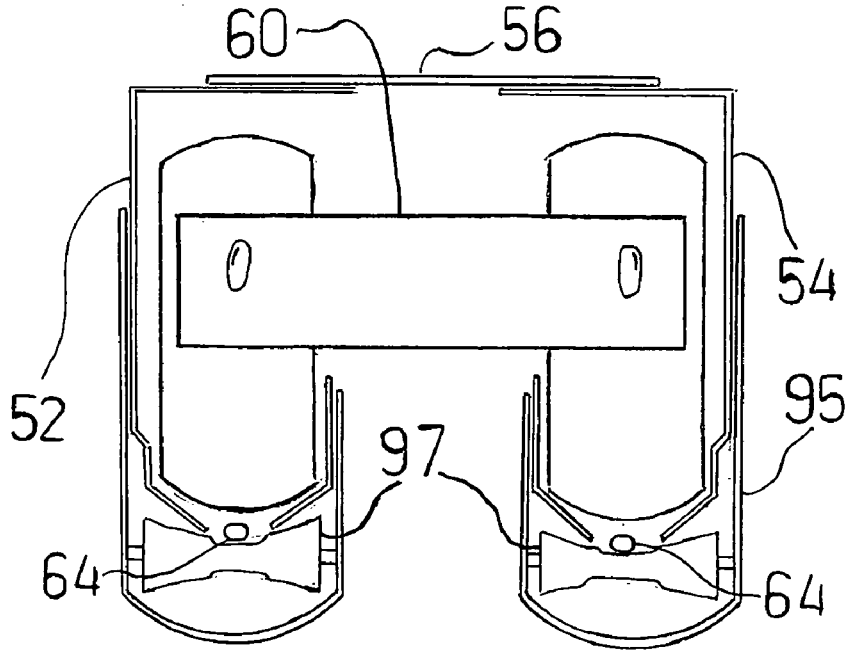
FIG. 5 shows a cross-section for the variation of the track's curved portions with a cord connecting car mounted thereon and with cord support rollers underneath the cord connecting car's wheels, and also connecting cord positions when the cars are not present.

The swing track structure can be widely varied but preferably comprises a pair of laterally spaced track channel members 52 and 54 attached to a track cross member 56 (FIGS. 4 and 5).

Figure 2:
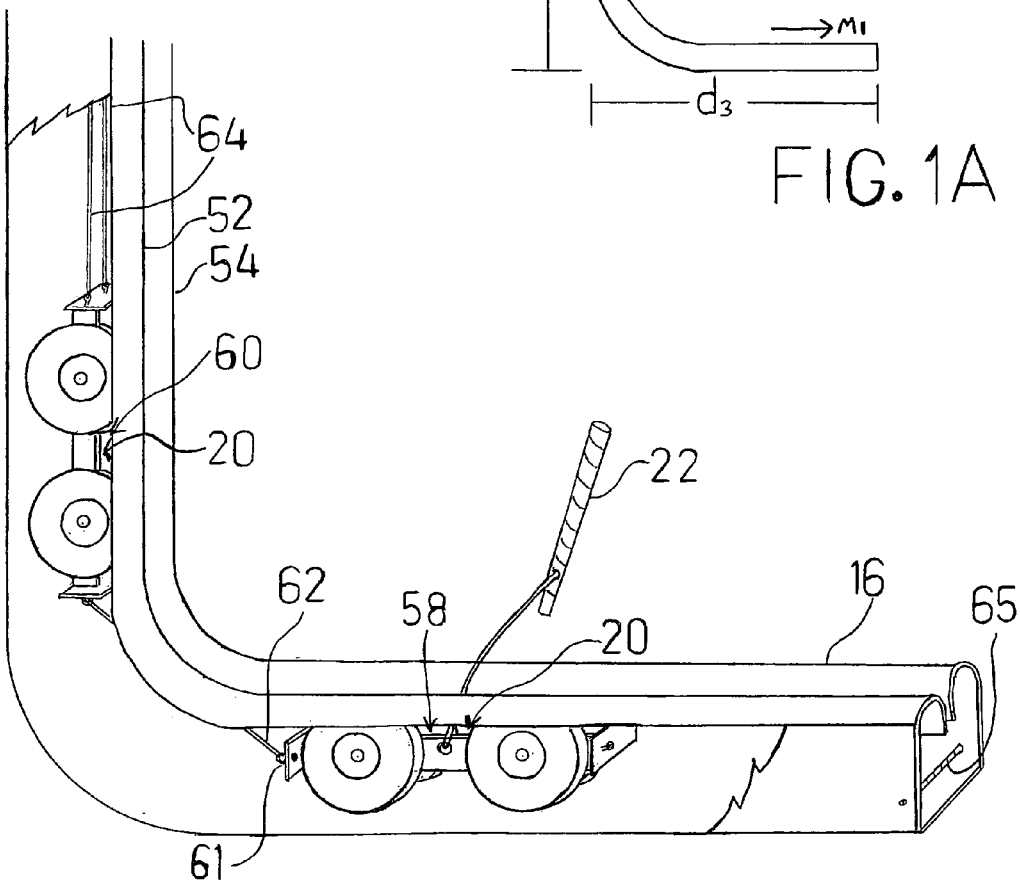
FIG. 2 is a perspective view of a portion of the swing track, drawn out of scale, with the wall sections broken away to show the pull-resistance connecting cords and the cord connecting cars.
Figure 3:
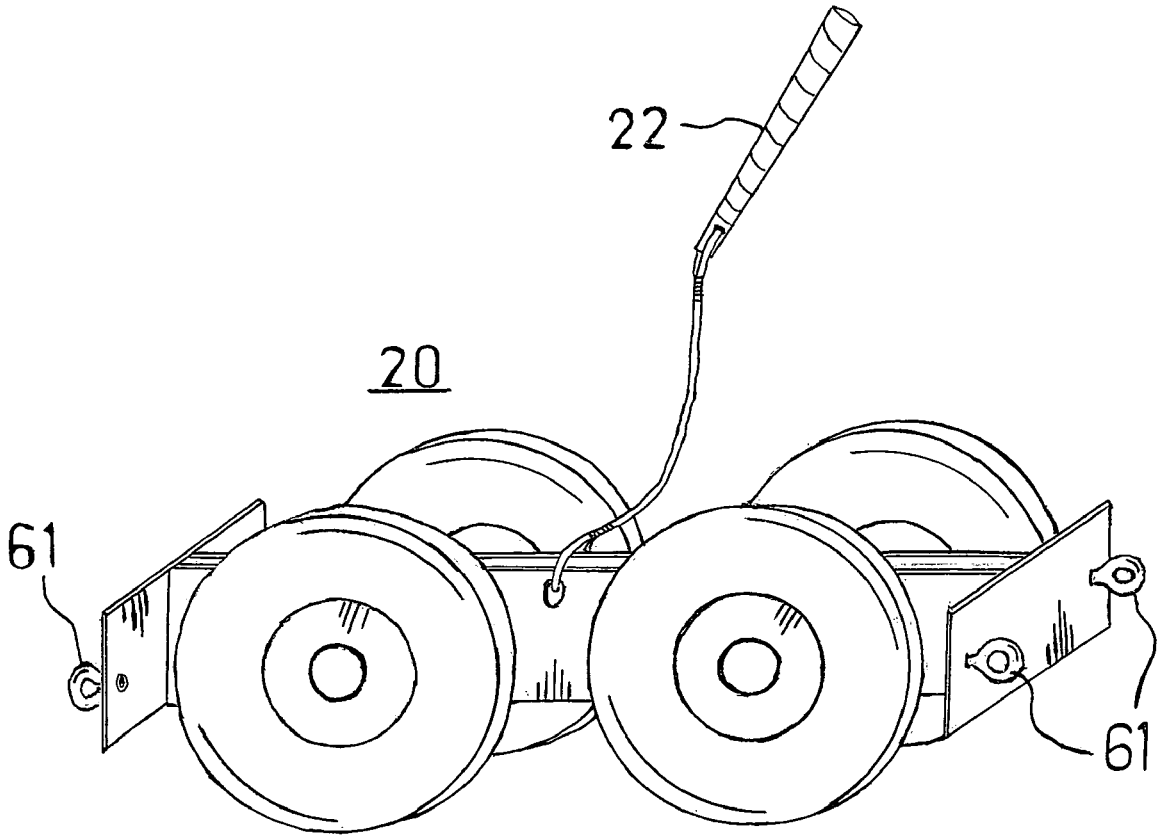
FIG. 3 is a perspective view of a cord connecting car with connecting car eyelets.

The arrangement of the track follower 20 shown in FIG. 2 is a preferred one and comprises of dual cord connecting cars 58 and 60 connected together at connecting car eyelets 61 (also in FIG. 3) on the cord connecting cars by connector cords 62, wherein the golf handle 22 is flexibly attached to the lead cord connecting car 58 (FIG. 3). This arrangement gives a smooth ride of the cord connecting cars around the track 16, however a single track follower 20 may alternatively be employed. Attachment of the golf handle 22 with a flexible tether line is preferred, allowing the golfer freedom to hold the handle in proximity to the track at address where the golfer feels most comfortable.

Figure 9:
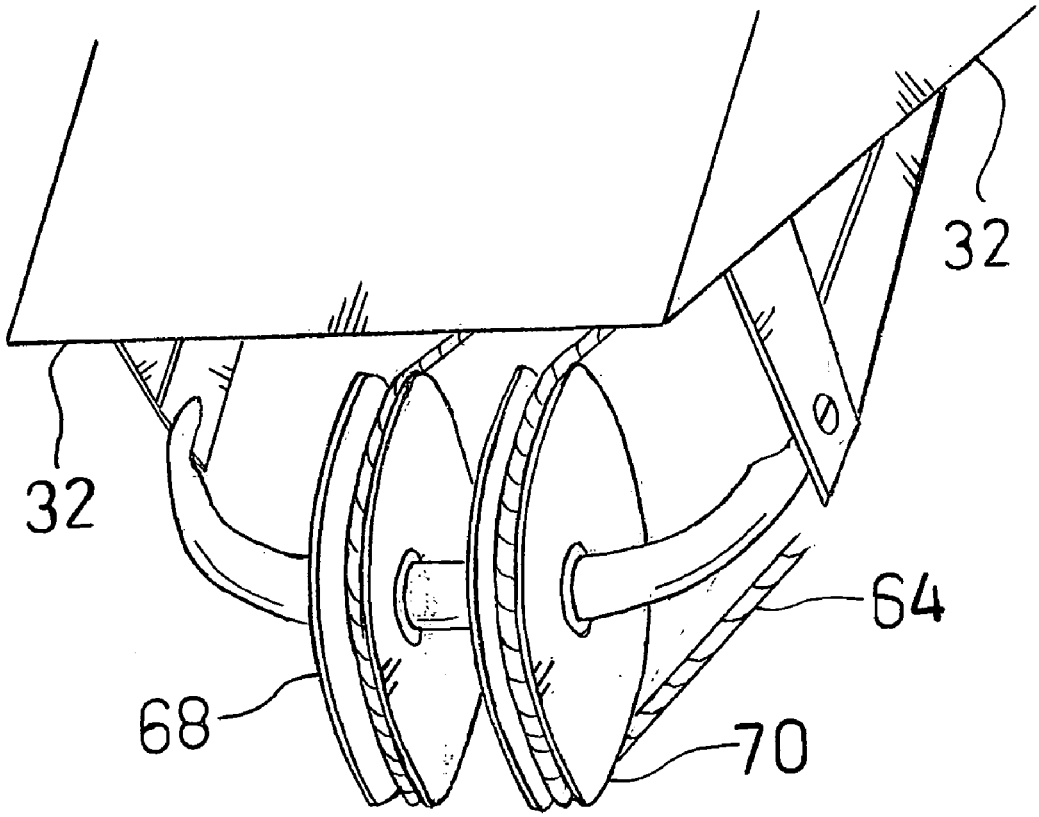
FIG. 9 is a perspective view of duel pulleys mounted to the overhead beam of the base structure at the proximal end of the swing track and includes duel cords.

The motion resistance structure 24 comprises dual cords 64 slidably in channels 52 and 54 as shown in FIGS. 1 and 2 and mounted around duel track end pulleys 68 and 70 (FIGS. 8 and 9) adjacent the proximal end 66 of the swing track 16 (FIGS. 1 and 8). Duel pulleys 72 are similarly mounted at the other end of the beam 32 and cords 64 run the length thereof and also around hanging duel weight pulleys 74 and then are affixed at cord fixture 76 to the beam (FIG. 1). Various sized resistance weights 78 can be hung from hanging duel weight pulleys 74 to vary the resistance or back force f1 on the cords 64 leading back to the handle 22.

Figure 10:
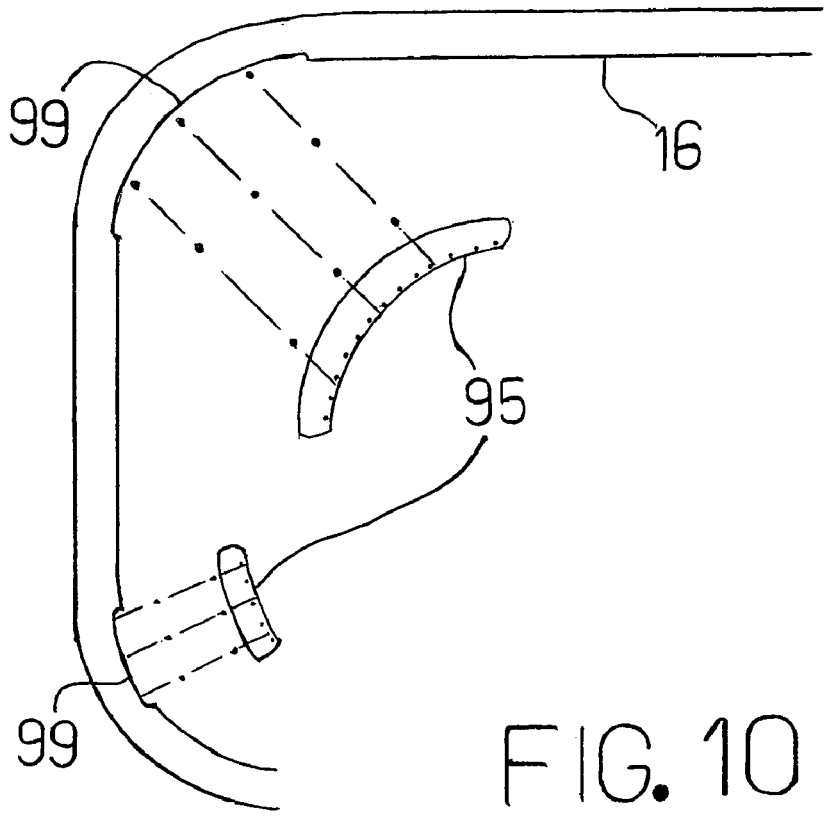
FIG. 10 shows the track roller sections and the placement of the roller sections on the swing track's curved portions over the track channel punch-outs.
Figure 10A:
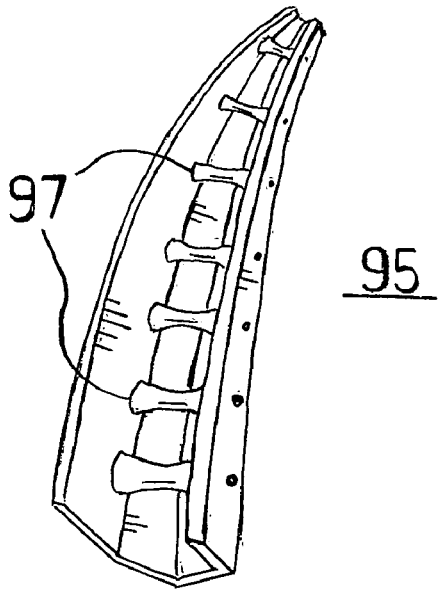
FIG. 10A is a perspective view of a track roller section and the cord support rollers attached at the lower channel of the roller section.
Figure 10B:
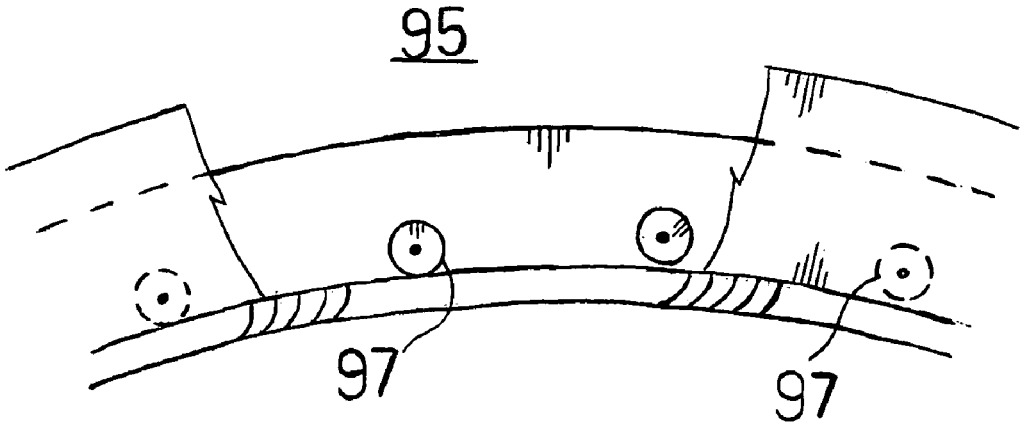
FIG. 10B is a portion of a track roller section with the wall broken away to show the cord support rollers attached in the lower channel.

The bottom of channels members 52 and 54 at both the top and lower curves of the swing track 16 are punched out at channel punch-outs 99 and covered with track roller sections 95 where the duel cords 64 would normally drag in the channels as shown in FIG. 10. The top curve of said swing track is completely punched out up to 90 degrees and the lower curve is partially punched out as both curves are covered with track roller sections 95 (FIG. 10). The cord support rollers 97 are affixed to the channel portion of the track roller sections 95 (FIGS. 5, 10A and 10B). The duel cords fall through the punched out portions of the track and onto the cord support rollers 97 (seen best in FIG. 5). The punched out portions of the swing track are narrower than the wheels on the cord connecting cars 58 and 60 shown in FIG. 5.

A track plane adjustment mechanism, generally designated 79 (FIGS. 1, 7 and 8), comprises a generally triangular frame of members 80, 82, and 84, affixed to the track 16 at the top half of d2 (FIG. 1A) using vertical member 80 (seen best in FIG. 7) and having a weight support 88 on which weights can be placed to vary the angle of the track swing plane 18 (FIG. 8) by pivoting the track on the support structure 14.

Figure 7:
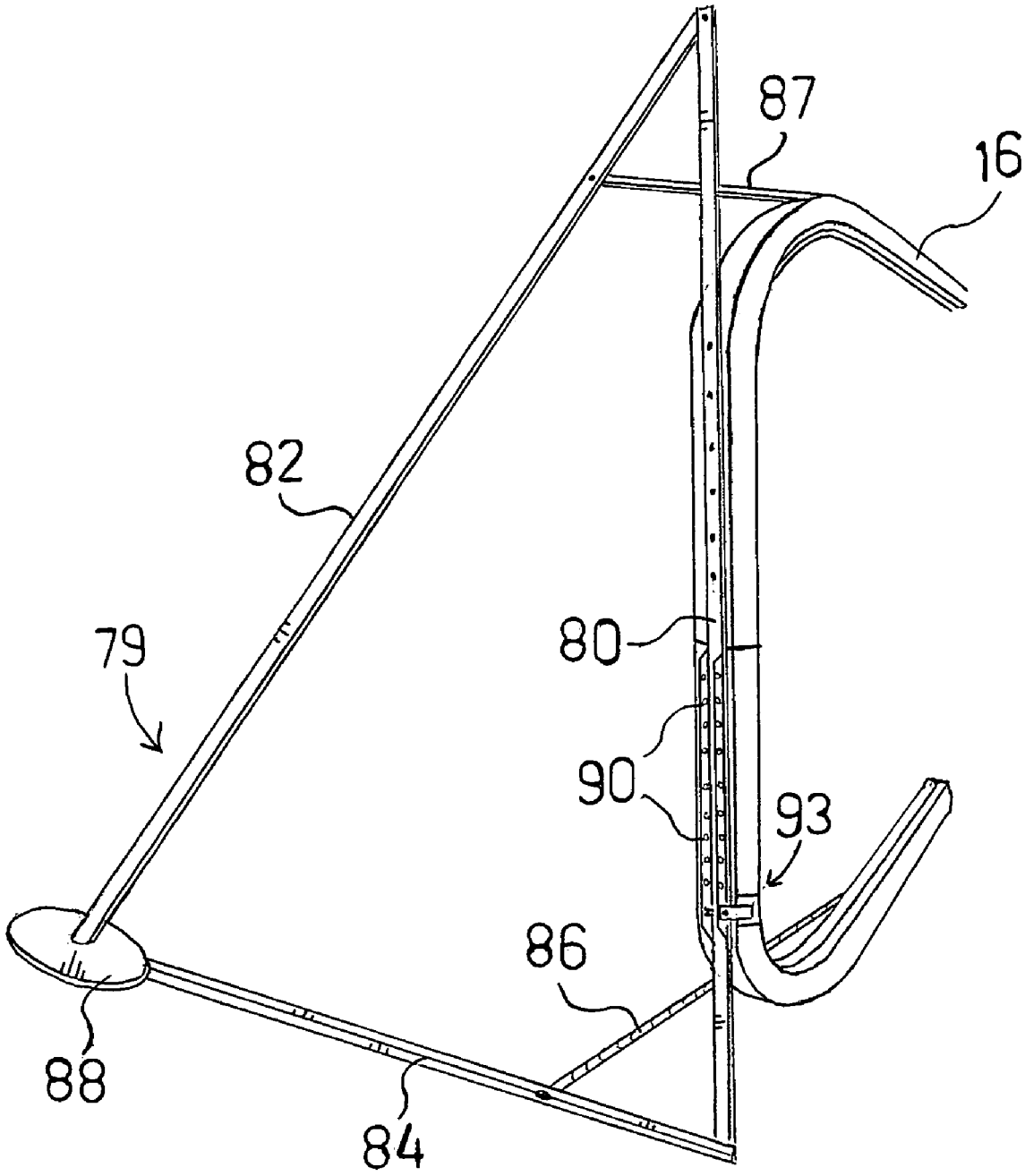
FIG. 7 is a rear perspective view of the invention showing the track plane adjustment mechanism with an attached weight support and also the track diameter adjustment mechanism connected to the lower portion of the swing guide track.
Figure 7A:
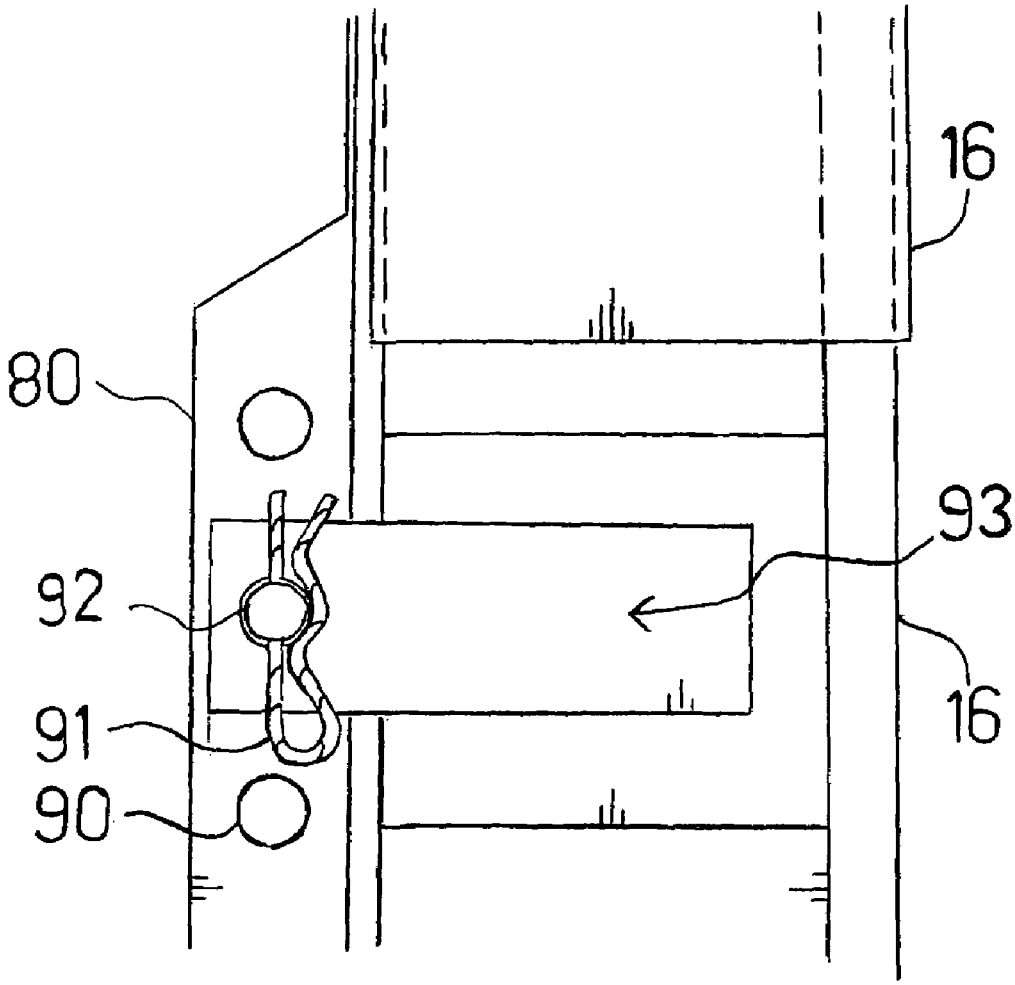
FIG. 7A shows the track diameter adjustment mechanism with cotter pin, cotter bolt and the diameter adjustment holes on the vertical member of the track plane adjustment mechanism.

At vertical segment d2 of the overall swing track curvature dimension (FIG. 1A) the lower half of the track 16 is slidable into the top half of the track to adjust the swing track diameter. The lower track half is variously affixed at the track diameter adjustment mechanism 93 to the track plane adjustment mechanism 79 shown in FIG. 7 using the diameter adjustment holes 90 of vertical member 80, a cotter bolt 92 and cotter pin 91 (FIG. 7A).

The invention has been described in detail with particular reference to preferred embodiments thereof, but it will be understood that variations and modifications will be effected with the spirit and scope of the invention.

Operation—FIGS. 1, 1A, 7, 7A, and 8

The settings that each golfer makes on the swing training apparatus are extremely important. No two people have the same swing so the settings will be only for that person. The settings would be duplicated each time the person uses the apparatus and would be easy to perform.

The height is set by adjusting the overlapping stanchion 30 sections 34 and 36 in FIG. 1 and affixing them with the stanchion pin 38 at stanchion overlap 33 so that the top of the swing track 16 is just higher than the golfer's hands at the top of the backswing. The diagonal 82 and horizontal 84 segments of the track plane adjustment mechanism 79 should be moved to the side of the swing track that the person intends to stand as shown in FIGS. 1, 7 and 8. Weights would be fastened on top of the weight support 88 until the swing track has achieved the desired swing plane angle 18 in FIG. 8. The bearing unit support structure 14 in FIG. 1 allows the swing track to move to any swing plane 18 and to freely rotate to follow the golfer's swing and for a limited amount of lateral movement.

The desired swing diameter is set by adjusting the overlapping vertical portion of the swing track 16 in FIG. 7 (d2 in FIG. 1A), so that the golfer's hands are just above the lower horizontal swing track portion (d3 in FIG. 1A) at address. The golfer lines up the diameter adjustment holes 90 on the vertical plane adjustment segment 80 with the holes on the track diameter mechanism 93 and slides a cotter bolt 92 thru the holes. The bolt is secured by a cotter pin 91 as shown in FIGS. 7 and 7A. With resistance weights 78 shown in FIG. 1 in the down position, additional weight units can be added, with only 5 to 15 lbs. of weight being all that is usually needed.

An additional optional piece, a stabilizing rod 86, may be wedged between the lower horizontal portion d3 (FIG. 1A) of the swing track 16 and the horizontal plane adjustment segment 84 as shown in FIG. 7. The stabilizing rod gives the swing-track a little more stability and more importantly puts the lower swing track d3 in an inside-out position which may help golfer obtain a better swing path image even though the swing track will follow the golfer's swing path. When the stabilizing rod is utilized, a stabilizing arm 87 is attached to the top portion of diagonal member 82 and to the top of the swing track at d1 to keep the track plane adjustment mechanism 79 perpendicular to the swing track 16 in FIG. 7.

Figure 1A:
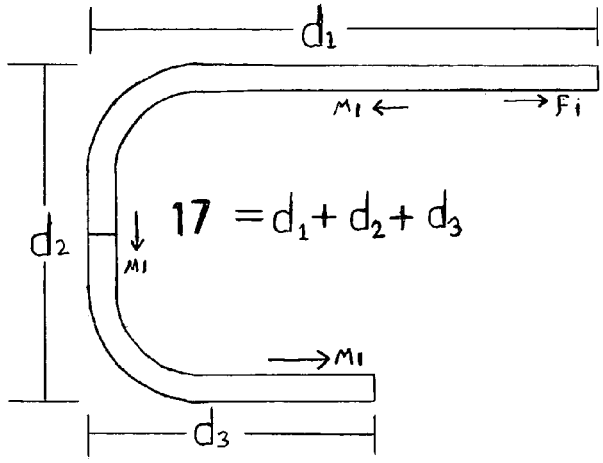
FIG. 1A is a schematic of the overall curvature dimension of the swing guide track.

With resistance weights 78 in the down position, the golf handle 22 will be at the top horizontal swing track portion d1 in FIG. 1A. The golfer now just pulls the golf handle down into the address position and the resistance weights are lifted up in the air. The golfer takes his/her normal stance so the golfer's hands on the backswing do not come in contact with the vertical portion d2 in FIG. 1A of the swing track 16. The golfer can now repeat the backswing, downswing and hitting area using his/her normal swing and working on parts of the swing that need stretching, strengthening or improved technique. The golf handle 22 can be pulled all the way past the end of the swing track 16 as the lead cord connecting car 58 will be halted by the car stop pin 65 in FIG. 2. If the golfer starts the downswing with lateral movement, the swing track 16 will move laterally automatically, using the support structure 14. The swing track will freely rotate during training to match the path of the golfer's swing.

If the golfer chooses to work on stretching the follow-thru of the swing, the horizontal 84 and diagonal 82 segments of the track plane adjustment mechanism 79 in FIGS. 1, 7 and 8, would be moved to the opposite side of the swing track 16. The golfer would then switch sides and reverse address direction in order to let the weights pull or stretch the parts of the body used in the follow-thru.

CONCLUSION, RAMIFICATIONS AND SCOPE

The reader will see that the golf swing training apparatus solves the problem of how to accommodate the entire backswing, downswing and hitting area, providing consistent pull or resistance throughout a movable swing plane while the swing plane is in motion. Furthermore, the present invention has additional advantages in that it allows golfers to just perform their normal swing to stretch and strengthen the golf muscles;

- it provides training in the minimum amount of time for maximum results;
- it allows older golfers to maintain, recapture or generally expand and strengthen their golf swings;
- it provides instant feedback for stretching, strengthening and making swing changes;
- it allows golfers to stretch and strengthen golf muscles in a proportionate manner so that coordination remains the same.

Although the description above contains many specificities, these should not be construed as limiting the scope of the invention but rather as an illustration of the preferred embodiment of the invention. For example, the base structure could have 2 or 3 legs or even 4 legs such as most swing sets. The base could also be ceiling studs from which the swing track is hung. The track could be low friction tubing or have an I-beam cross-section shape or the channels could be affixed back-to-back with the connecting cars underneath. Variable motion resistance could be supplied by springs, bowed flexible material or a wound spring mechanism. Support structures allowing swing track motion might include universal joints, an axle and bearing, chain links or some other flexible material. The track plane adjustment mechanism could comprise of adjustable springs or counter weights hung by pulley attached to the base and track. The swing track could of course be shortened by excluding the lower horizontal portion—d3. To adjust the diameter of the swing track, telescopic elements could be employed or just a thumb screw to affix the slidable track sections. The base structure height adjustment could be performed with a side crank, jack, telescopic elements or inner strut and lock screw. Depending on such factors as the weight of the swing track or the size of the support structure, a bumper cushion may be affixed at the proximal end of the swing track to keep the track from moving too far upward during lateral movement, causing the track to hit the beam or the cords above the track.

I claim:

1. An apparatus for training a golfer's swing comprising a base structure, support structure for hanging a generally upright arcuate swing guide track from said base structure, said track having an overall curvature dimension subtending an arc of at least 90 degrees, said track having a generally straight vertical segment of less than 30 degrees of said overall curvature dimension, wherein said base structure is stationary and wherein said support structure is flexible to allow said track a limited freedom of motion relative to said base structure during usage, track follower structure engaging said track for movement there along throughout said curvature dimension, a handle affixed to said follower structure for being gripped by a golfer for movement of said follower structure by said golfer along said track, and motion resistance structure connected to said base structure and said follower so as to provide a back force to forward motion of said handle and follower structure through said curvature dimension whereby the golfer's swing muscles become strengthened against the back force and the muscles become stretched with backward motion of said handle by the back force and the swing becomes longer and stronger with regard to it's trajectory and force.

2. The apparatus of claim 1 wherein track plane adjustment mechanism is provided on said swing guide track so as to adjust the initial verticality of said swing track for accommodating various swing plane angles.

3. The apparatus of claim 1 wherein said motion resistance structure connected to said base structure and said follower is provided with means for varying the back force whereby the golfer predetermines the level of resistance or back force to exercise.

4. The apparatus of claim 1 wherein track diameter adjustment mechanism is provided on said generally straight vertical segment-of said swing guide track for adjusting the diameter of said swing track so as to accommodate various sized golf swings.

5. The apparatus of claim 1 wherein stanchion height adjustment mechanism is provided on said base structure so as to adjust the height of said swing track for accommodating various statures.

* * * * *